US011077922B2

(12) United States Patent
Brimberg

(10) Patent No.: US 11,077,922 B2
(45) Date of Patent: Aug. 3, 2021

(54) SYSTEM FOR DAMPING MOVEMENTS OF A LOAD OVER A FLUCTUANT WATERY ENVIRONMENT AND A VEHICLE COMPRISING SAME

(71) Applicant: YARIV CIVIL ENGINEERING (1989) LTD., Tel Aviv-Jaffa (IL)

(72) Inventor: Itzhac Brimberg, Givataim (IL)

(73) Assignee: YARIV CIVIL ENGINEERING (1989) LTD., Tel Aviv-Jaffa (IL)

( * ) Notice: Subject to any disclaimer, the term of this patent is extended or adjusted under 35 U.S.C. 154(b) by 391 days.

(21) Appl. No.: 16/071,404

(22) PCT Filed: Jun. 5, 2017

(86) PCT No.: PCT/IL2017/050626
§ 371 (c)(1),
(2) Date: Jul. 19, 2018

(87) PCT Pub. No.: WO2017/212482
PCT Pub. Date: Dec. 14, 2017

(65) Prior Publication Data

US 2020/0216151 A1 Jul. 9, 2020

(30) Foreign Application Priority Data

Jun. 6, 2016 (GB) ..... 1609855

(51) Int. Cl.

| | |
|---|---|
| ***B63B 1/14*** | (2006.01) |
| ***B63B 39/00*** | (2006.01) |
| ***B63B 1/12*** | (2006.01) |
| ***B63B 43/04*** | (2006.01) |

(52) U.S. Cl.
CPC ..... *B63B 39/005* (2013.01); *B63B 1/12* (2013.01); *B63B 1/14* (2013.01); *B63B 43/04* (2013.01); *B63B 2001/145* (2013.01)

(58) Field of Classification Search
CPC ..... B63B 1/14; B63B 2001/145; B63B 43/04; B63B 43/14; B63B 39/005; B63B 43/10
See application file for complete search history.

(56) References Cited

U.S. PATENT DOCUMENTS

| | | | | |
|---|---|---|---|---|
| 1,344,903 | A * | 6/1920 | Koiransky | B63B 1/14 114/61.16 |
| 2,313,295 | A | 3/1943 | Herail et al. | |
| 2,678,017 | A * | 5/1954 | Collins | B63B 35/4413 114/265 |
| 3,592,154 | A | 7/1971 | Holmes | |
| 2017/0001690 | A1* | 1/2017 | Huenefeld | B63B 39/02 |

FOREIGN PATENT DOCUMENTS

| | | | |
|---|---|---|---|
| FR | 2607097 | A1 | 5/1988 |
| FR | 2906216 | A1 | 3/2008 |
| JP | H0872783 | A | 3/1996 |
| WO | 2007070674 | A1 | 6/2007 |
| WO | 200804099 | A | 4/2008 |
| WO | 2016081990 | A1 | 6/2016 |

* cited by examiner

*Primary Examiner* — Andrew Polay
(74) *Attorney, Agent, or Firm* — Novick, Kim & Lee, PLLC; Jae Youn Kim

(57) ABSTRACT

A damping system is presented for damping an oscillation of a load on a fluctuant water surface. The damping system may include four buoyancy systems, two on each side of the load. Each buoyancy system may include two buoys, a lower frame and an upper frame.

12 Claims, 4 Drawing Sheets

SYSTEM FOR DAMPING MOVEMENTS OF A LOAD OVER A FLUCTUANT WATERY ENVIRONMENT AND A VEHICLE COMPRISING SAME

FIELD OF THE INVENTION

The present invention generally relates to devices, apparatuses, systems and mechanisms for damping fluctuations of loads over fluctuant watery environments and crafts including such systems, devices, apparatuses or mechanism.

BACKGROUND OF THE INVENTION

Watercrafts and other bodies that are designated for floating or sailing over fluctuant watery environments such as over the seas, lakes, rivers and the like, often jiggle and wiggle in direct response to the fluctuations (waves) of the water causing onboard load damages and often causing seasickness for onboard people. In more severe cases, in which the fluctuations are extreme (e.g. waves are extremely high) the watercraft can turn and sink.

There are several available solutions for damping these fluctuations. For example:

International patent application publication no. WO 2007070674 teaches pairs of counter-rotating regenerative flywheels, which create reinforcing torques when electrical energy is transferred between the members of a pair. The transfer, of electricity can be controlled to counter undesired oscillations of a watercraft. Motion of the watercraft is sensed by a sensor system, resolved into components and then the flywheels are controlled to apply torque that counteracts the undesired oscillation. Preferably, the motion of the watercraft is evaluated by the sensor in brief increments of one-tenth of a second or less.

Patent application no. FR2906216 teaches a device that has a spring and a damper associated to two parallel sliding systems. The sliding systems are fixed between an arm head and a rotation axle fixed on an arm base. An anti-rotation unit is fixed between the axle and the head. The sliding systems are slid for provoking compression and releasing of the spring and the damper during navigation so as to absorb the impact at a handle bar of a personal watercraft.

Patent application no. JPH0872783 teaches a wave impact buffering mechanism for a catamaran watercraft. The catamaran ship is provided with a pair of pitching restraining horizontal fins extending left and right symmetrically toward the center line of the hull respectively from the lower ends of a pair of left and right hulls provided to project downward from the left and right broadsides of the bow bottom part of the catamaran ship, a plurality of air jetting small diameter apertures opened at an equal interval along the outer periphery of the lower surface of the horizontal fin 4*a* are arranged.

SUMMARY OF THE INVENTION

The present invention provides a damping system for damping an oscillation of a load on a fluctuant water surface. According to some embodiments, the system includes two pairs of buoyancy systems, each pair positioned on an opposite side of the load, each buoyancy system having two buoys, a lower frame and an upper frame. Each buoy may be pivotally connected to the lower frame, and each lower frame may be pivotally connected to the upper frame by a lower frame hinge. Each upper frame having one or more central connectors connectable to the load, and the buoys on each side may be arranged in a columnar manner.

According to some embodiments, each buoy is connected to the lower frame by a buoy axle.

According to some embodiments, one or more of the upper frames are rigidly or pivotally connectable to the load by the central connector.

According to some embodiments, an angular position of the central connector may be controlled by mechanical or electronic means.

According to some embodiments, the damping system is further configured such that when the damping system is connected to the load, the buoyancy systems are located at an equal distance from the center of mass of the load.

According to some embodiments, the buoyancy systems are symmetrically located about the center of mass of the damping system.

According to some embodiments, the damping system is further configured such that when the damping system is connected to the load, the at least two buoyancy systems are located at unequal distances from the center of mass of the load.

According to some embodiments, a distance between each buoyancy system is adapted for damping a predetermined wavelength of oscillation.

The present invention also provides a vehicle designed for damping an oscillation of a load on a fluctuant water surface, the vehicle including the load and a damping system, wherein the damping system includes two pairs of buoyancy systems, each pair positioned on an opposite side of the load. Each buoyancy system may include two buoys, a lower frame and an upper frame, each buoy being pivotally connected to the lower frame, each lower frame being pivotally connected to the upper frame by a lower frame hinge, each upper frame being connected to the load, and wherein the buoys on each side of the load are connected in a columnar manner about the lower frame hinge.

According to some embodiments, the load of the vehicle is a cargo container.

According to some embodiments, each buoy is pivotally connected to the lower frame by a buoy axle.

According to some embodiments, one or more of the upper frames are connected to the load by a central connector whose angular position may be controlled by at least one of mechanical and electrical means.

The present invention further provides a buoyancy system designed for damping an oscillation of a load on a fluctuant water surface, the buoyancy system comprising two buoys, a lower frame and an upper frame, each buoy being pivotally connected to the lower frame, the lower frame being pivotally connected to the upper frame by a lower frame hinge, the upper frame having one or more central connectors connectable to the load, and wherein the buoys are connected in a columnar manner.

BRIEF DESCRIPTION OF THE DRAWINGS

FIG. 1A shows an elevated view of the damping system; and FIG. 1B shows an isometric perspective view of the damping system.

DETAILED DESCRIPTION OF SOME EMBODIMENTS OF THE INVENTION

Figure 1A:
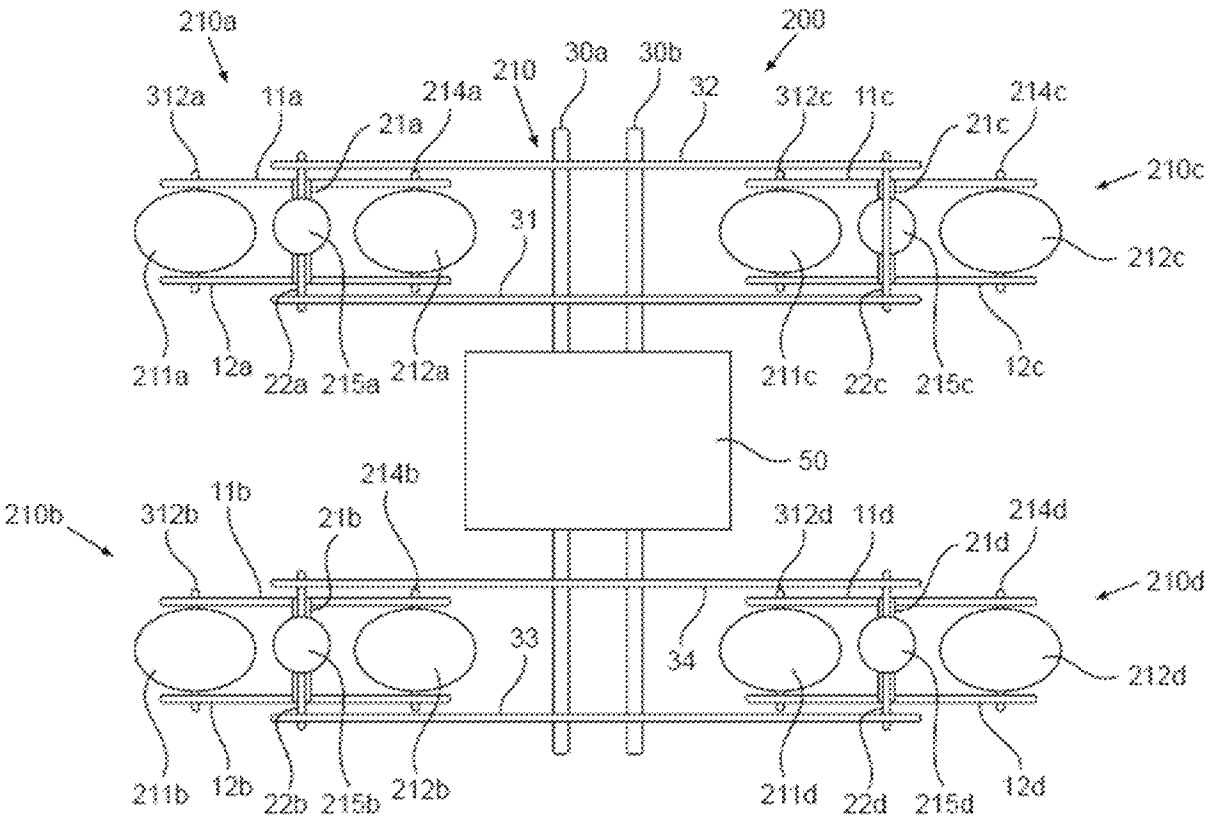
FIGS. 1A and 1B show a damping system for damping movements of a load placed thereover or connected thereto, such as a vehicle or a cargo over a fluctuant watery environment, having four buoyancy systems, each including two buoys, according to some embodiments of the invention.

In the following detailed description of various embodiments, reference is made to the accompanying drawings that form a part thereof, and in which are shown by way of illustration specific embodiments in which the invention may be practiced. It is understood that other embodiments may be utilized and structural changes may be made without departing from the scope of the present invention.

The present invention provides systems for damping movements of a load placed or connected thereover in a fluctuant watery environment, and crafts such as water or air crafts with such damping systems.

According to some embodiments of the invention, the damping system includes several buoyancy systems, each buoyancy system having at least one buoy. According to the present invention, the buoys of the damping system directly or indirectly connect to the load or to a base structure that carries the load in an articular manner e.g. via joint connectors, for allowing the buoys to mechanically respond to the oscillations (fluctuations) of the water which will cause the damping of the fluctuations of the load.

The damping system is designed such as to have the buoys freely or partially freely rotate about an axis in response to the water fluctuations/oscillations in the respective location thereof over the water. Each buoyancy system is positioned at a distance from the center of mass of the load such they are spread from the spatial borders of the load and/or carrier thereof. Due to this separation and spreading of each buoy a different fluctuation is applied over each buoy. Each is located over a different positioning over the incoming wave (s) and therefore the buoys of all the buoyancy systems will dissipate the waves' energy, damping thereby the oscillatory energy that would have otherwise been applied over the load center of mass. This will allow dramatically reducing the oscillation energy delivered to the load.

The geometry and the locations of the buoyancy systems in respect to the load or carrier thereof, the number thereof, the properties of the buoys thereof etc. can be adapted to the particular load type and optionally to the carrier properties and type that are to be used.

According to some embodiments of the invention, the damping system further includes a base structure fixedly or movably connected to the connectors of the buoys systems for carrying the load thereover.

According to some embodiments, each buoyancy system movably connects to this base structure e.g. via at least one bearing or any other articulation.

According to some embodiments, the buoyancy systems may be located at equal distances from the center of mass of the load or of the entire structure of the systems and the load. For example, the buoyancy systems can be symmetrically arranged around the center of mass of the load.

In other embodiments, the buoyancy systems are located at different distances from the center of mass of the load or of the entire structure of the systems and the load.

The buoys of the damping system may have any size or shape that is adapted to improve damping in respect to the distance thereof from the load center of mass, depending on the number of buoys used and spatial arrangement thereof.

For instance each buoy may be pivotally rotated over an axis such as a rod. The axis may be connected to crank shafts connectors, one at each edge thereof for connecting thereto fixedly or pivotally/movably to a frame base structure that is configured for placing the load thereover or connecting the load thereto.

Since the system and load are configured for being used in a fluctuant watery environment such as an ocean, a sea, a river, a lake and the like, the load may be any kind of element, vehicle or system that can either float even without the damping system or only once placed over or connected to the damping system.

The present invention further provides a vehicle such as a watercraft or an aircraft designed to land and optionally also sail or float on water, having the damping system integrated therewith. In this case the load may be the vehicle body and inner equipment thereof. In this case the entire integrated vehicle includes the vehicle unit e.g. the boat, aircraft or raft body and the damping system.

The vehicle may be a motorized vehicle such as a motorboat, an aircraft, a speedboat, a steamboat and the like or a non-motorized vehicle such as a raft, a sailboat, a pedal boat and the like.

The vehicle unit may be buoyant regardless of the damping system thereof or may only be able to float on water once connected to or placed over the damping system in which case also serving as a float mechanism for the craft. The vehicle may also be a mono-hull or a multi-hull watercraft. Additional stabilizing or buffering means may be added to the vehicle and/or damping system for improving stability thereof over the water environment such as sets of spring connectors for absorbing some of the movements' impact to prevent abrupt tilting or elevation of the load/craft.

Figure 1B:
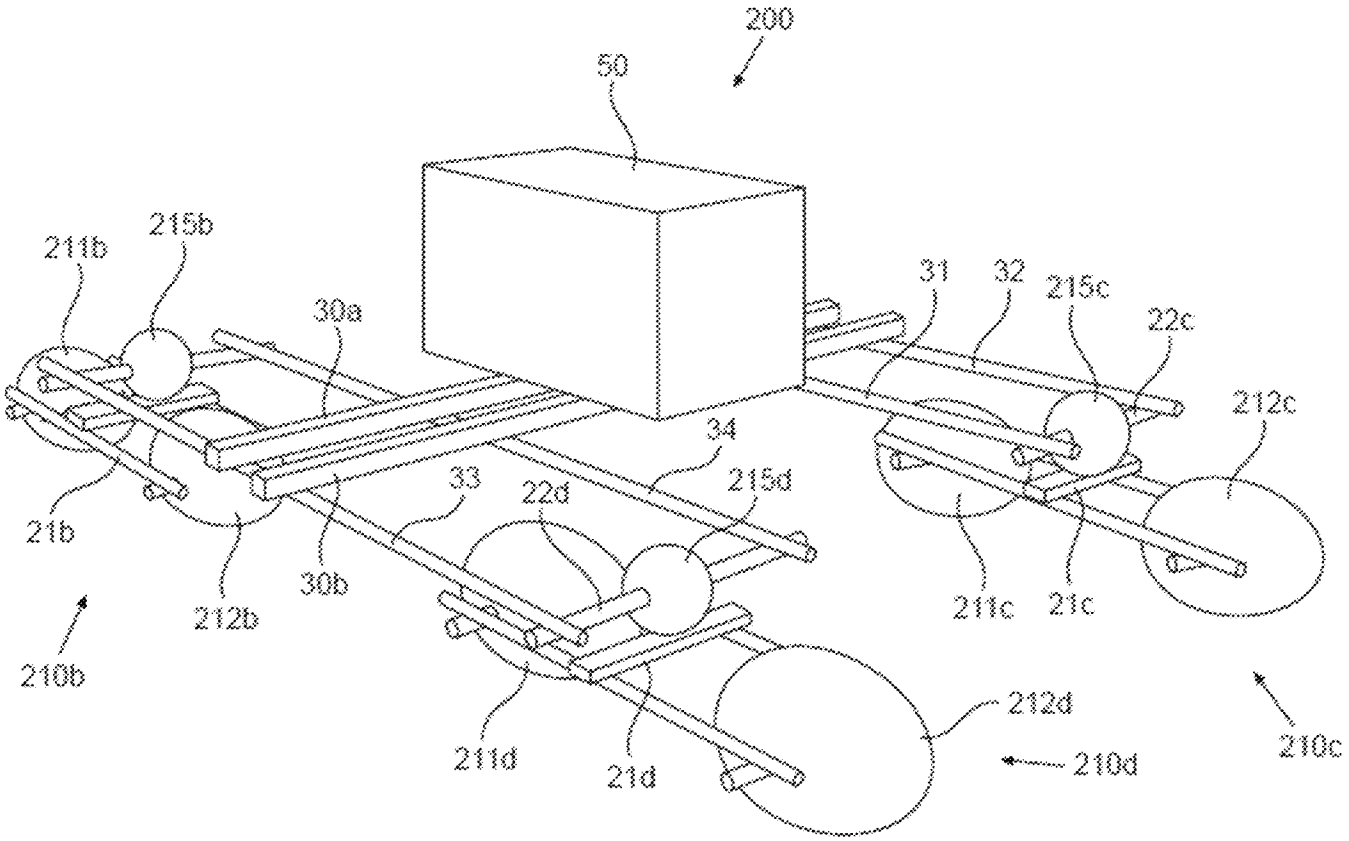

Reference is now made to FIGS. 1A and 1B illustrating a damping system 200 for carrying thereover a load 50 such as a cargo container and/or vehicle or connecting to a vehicle, according to some embodiments of the invention. The damping system 200 comprises four buoyancy systems 210*a*, 210*b*, 210*c* and 210*d*: two front buoyancy systems 210*a* and 210*b* and two rear buoyancy systems 210*c* and 210*d*; and a frame base structure 210 movably connected to the buoyancy systems 210*a*-210*d* via bearings 215*a*, 215*b*, 215*c*, and 215*d* respectively.

Each of the buoyancy systems 210*a*-210*d* has two buoys: the first front buoyancy system 210*a* has buoys 211*a* and 212*a* pivotally connected to connectors 11*a* and 12*a* via axles 312*a* and 214*a* such that the axles 312*a* and 214*a* are parallel to one another. Similarly, the second front buoyancy system 210*b* has buoys 211*b* and 212*b* pivotally connected to connectors 11*b* and 12*b* via axles 312*b* and 214*b* such that the axles 312*b* and 214*b* are parallel to one another. The first and second rear buoyancy systems 210*c* and 210*d* have buoys 211*c* and 212*c* and 211*d* and 212*d*, respectively, pivotally connected to connectors 11*c* and 12*c* and 11*d* and 12*d* via axles 312*c* and 214*c* and 312*d* and 214*d*, such that the axles 312*c* and 214*c* are parallel to one another and axles 312*c* and 214*d* are parallel to one another.

Each pair of buoys in each of the buoyancy systems 210*a*-210*d* are arranged one after the other in a columnar manner and in this case have an oval shape and are of the same shape and sizes.

According to some embodiments, as illustrated in FIGS. 1A and 1B, the frame base structure 210 (shortly referred to herein as "the base structure" 210) comprises multiple connecting members detailed as follows:

Multiple central connectors such as central connectors 30*a* and 30*b* over which the load is to be mounted or to which the load is to connect.

The first front buoyancy system 210*a* movably connects to the first rear buoyancy system 210*c* by having two bearings 215*a* and 215*c* movable associating with connecting members 31 and 32 connect to tow axles 22*a* and 22*c* of the bearings 215*a* and 215*c*. Each of the bearings 215*a* and 215*c* fixedly connects to a bar 21*a* or 21*c*, respectively. The bar 22*a* of the first front buoyancy system 210*a* connects to the connectors 11*a* and 12*a*. Similarly, the bar 22*c* of the first rear buoyancy system 210*c* connects to the connectors 11*e* and 12*c*.

Similarly, the second front buoyancy system 210*b* movably connects to the second rear buoyancy system 210*d* by having two bearings 215*b* and 215*d* movable associating with connecting members 33 and 34 connect to tow axles 22*b* and 22*d* of the bearings 215*b* and 215*d*. Each of the bearings 215*b* and 215*d* fixedly connects to a bar 21*b* or 21*d*, respectively. The bar 22*b* of the second front buoyancy system 210*b* connects to the connectors 11*b* and 12*b*. Similarly, the bar 22*d* of the second rear buoyancy system 210*d* connects to the connectors 11*d* and 12*d*.

The embodiments illustrated in FIGS. 1A-1B show a rectangular buoyancy systems' 210*a*-210*d* symmetry. However, many other configurations may be used for implementing the main principles of the present invention such as using a non-even number of buoyancy systems each separated from each other at an equal distance and angle or at different distances and angles. The number of buoys in each buoyancy system may also vary. The buoys in each system may have the same size and/or shape or of different size and/or shape.

According to other embodiments of the invention, each buoyancy system may be directly connected to the load or to a carrier thereof such as a load platform or base structure and not connected directly to any of the other one or more buoyancy systems.

The geometry of the damping system i.e. the distance between each buoyancy system from the load and from one another, the size, shape and number of the buoys, the symmetry of the structure and the like may be adapted to each particular load i.e. for each load weight, size, shape, expected changes in these properties and the like as well as to the fluctuant watery environment. For example, for vehicles expected to sail over extreme fluctuation conditions in the ocean the distance between each buoyancy system and the load may be adapted to the optimum, expected wavelengths such as to achieve damping thereof for less than half wavelength expected energy. This means for instance, that the system will be designed such that for waves of up to ten meters height (in amplitude) the damping system is adapted to have the center of mass of the entire craft be impacted by energy equivalent to a two meters height, due to the damping effect of the damping system.

According to some embodiments, the damping system can be integrated with a watercraft or a vehicle that can transform into or be used as a watercraft such as a seaplane.

Figure 2:
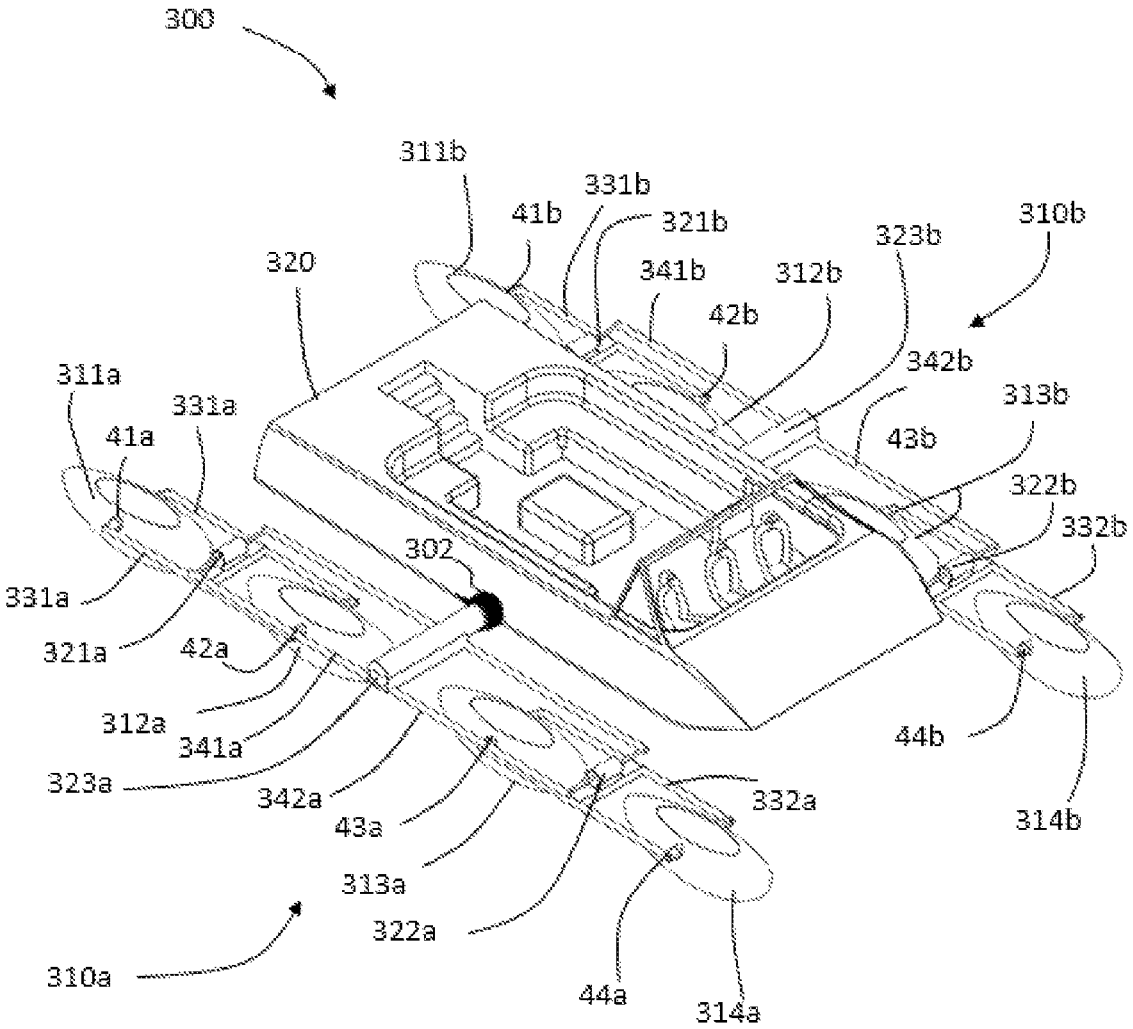
FIG. 2 shows a watercraft with a damping system integrated therewith, according to other embodiments of the present invention.

Reference is now made to FIG. 2 showing a watercraft 300 having a damping system integrated therewith, according to some embodiments of the present invention. The watercraft 300 includes a vehicle unit, which has a boat-shaped body 60 having seats, steering and optionally motorization means (not shown); and two buoyancy systems 310*a* and 310*b* connecting to the vehicle unit 320 via connectors 323*a* and 323*b* respectively.

In some embodiments the connectors 323*a* and 323*b* can be adjustable in length and/or in angle in respect to the vehicle unit 320 for changing the respective geometry of the buoyancy systems 310*a* and 310*b* to adapt to changing fluctuation environmental conditions, for instance. The watercraft 300 in this case may either be configured for a manually-controlled adjustment or via a controller 302 that is electronically controlled to make the mechanical adjustment. In other embodiments the connectors automatically adjust to environmental conditions either by mechanically responding to the forces applied thereover or by having sensors sense the environmental conditions and adapt the length and/or angle of the connectors 323*a* and 323*b* accordingly.

In other embodiments, the connectors 323*a* and 323*b* are non-adjustable and have a fixed angular positioning and length.

The length and/or angular positioning of the connectors 323*a* and 323*b* may be the same or different.

According to some embodiments, as illustrated in FIG. 2, the buoyancy systems 310*a* and 310*b* are located opposite to one another at each side of the vehicle unit 60. Each of the buoyancy systems 310*a* and 310*b* comprises four buoys: the first buoyancy system 310*a* comprises buoys 311*a*, 312*a*, 313*a* and 314*a*; the second buoyancy system 310*b* comprises buoys 311*b*, 312*b*, 313*b* and 314*b*.

In each buoyancy system each pair of buoys movably connects to a frame thereof in an articular manner: In the first buoyancy system 310*a* the front pair of buoys 313*a* and 314*a* pivotally connect to a lower frame 332*a* via axles 43*a* and 44*a*, which pivotally connect to an upper frame 342*a* via a hinge 322*a*; the rear pair of buoys 311*a* and 312*a* pivotally connect to a lower frame 331*a* via axles 41*a* and 42*a*, which pivotally connect to an upper frame 341*a* via a hinge 321*a*.

Similarly, in the second buoyancy system 310*b* the front pair of buoys 313*b* and 314*b* pivotally connect to a lower frame 332*b* via axles 43*b* and 44*b*, which pivotally connect to an upper frame 342*b* via a hinge 322*b*; the rear pair of buoys 311*b* and 312*b* pivotally connect to a lower frame 331*b* via axles 41*b* and 42*b*, which pivotally connect to an upper frame 341*b* via a hinge 321*b*.

In this illustration, shown in FIG. 2, the buoys 311*a*-314*a* and 311*b*-314*b* have the same oval shape and size and are located in a columnar manner one after the other such that the axles of the buoys of each buoyancy system are parallel.

Figure 3:
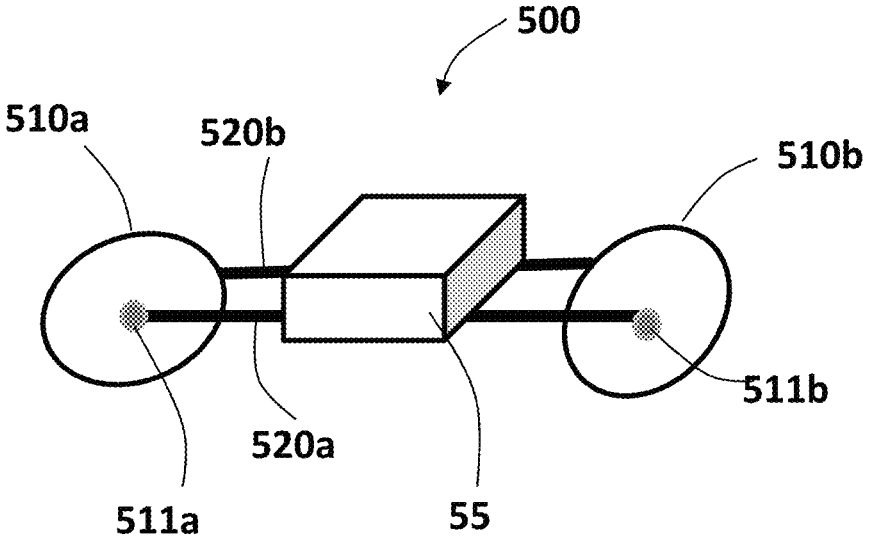
FIG. 3 shows a damping system for damping movements of a load placed thereover having two buoyancy systems, each including a single buoy, according to some embodiments of the invention.

Reference is now made to FIG. 3 which shows a very basic and simple configuration of a damping system 500, according to some embodiments of the present invention. This damping system 500 comprises two buoyancy systems, each having a single buoy 510*a* and 510*b*, pivotally connected to one another via axles 511*a* and 511, which connected to connectors 520*a* and 520*b* for carrying a load 55 thereover. Each buoy 510*a* and 510*b* can freely rotate about its axle 511*a* and 511*b*, respectively, in response to water fluctuations for damping the fluctuations applied over the load 55.

Figure 4:
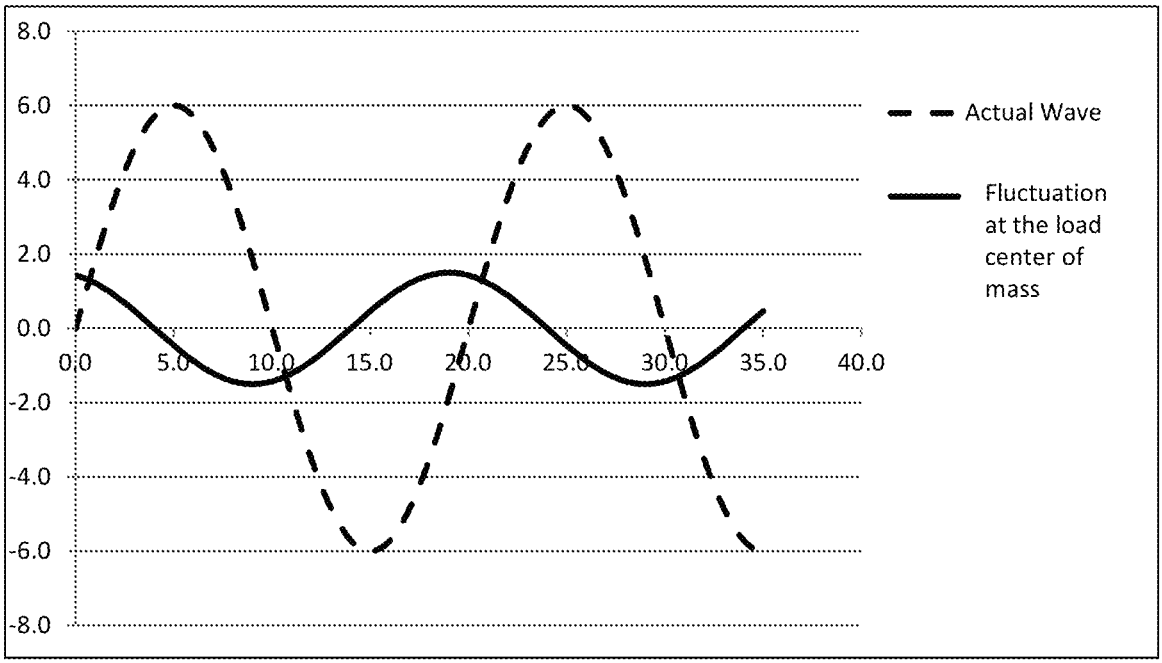
FIG. 4 shows a diagram of an estimated damping of a sinusoidal oscillation wave (continuous line) done by a damping system according to some embodiments of the present invention; the actual oscillations that are estimated to be measured at the center of mass of the load carried by the damping system is illustrated by the broken line showing a fraction of the amplitude of the sinusoidal oscillation wave.

FIG. 4 shows a graph of an estimated damping of a sinusoidal oscillation wave (continuous line) done by a damping system according to the present invention; the actual oscillations that are estimated to be measured at the center of mass of the load carried by the damping system is illustrated by the broken line showing a fraction of the amplitude of the sinusoidal oscillation wave. In this estimation the damping system damped the amplitude of the original oscillations to less than a third. Using larger buoys and/or more buoyancy systems may further reduce the amplitude at the load. The number of buoyancy systems, their design and/or distance from the load center of mass may be adapted to each watercraft specifically taking into account the maximal expected oscillations behavior in the expected watery environment, the design of the craft, the loads etc.

As mentioned above, the damping system of the present invention may be configured for being added to an existing watercraft or load or be integrated to the watercraft. The damping system may include any number of buoyancy systems and each buoyancy system may have any number of buoys in any possible shape and dimensions.

Many alterations and modifications may be made by those having ordinary skill in the art without departing from the scope of the invention. Therefore, it must be understood that the illustrated embodiment has been set forth only for the purposes of example and that it should not be taken as limiting the invention as defined by the following invention and its various embodiments and/or by the following claims. For example, notwithstanding the fact that the elements of a claim are set forth below in a certain combination, it must be expressly understood that the invention includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the invention is explicitly contemplated as within the scope of the invention.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

Although the invention has been described in detail, nevertheless changes and modifications, which do not depart from the teachings of the present invention, will be evident to those skilled in the art. Such changes and modifications are deemed to come within the purview of the present invention and the appended claims.

The invention claimed is:

1. A damping system for damping an oscillation of a load configured to travel on a fluctuant water surface, wherein a direction of travel defines a front, a back, and sides of the load, the damping system comprising:

four buoyancy systems, two on each of the sides of the load, each buoyancy system comprising two buoys, a lower frame and an upper frame, each buoy being pivotally connected to the lower frame by a buoy axle, each lower frame being pivotally connected to the upper frame by a lower frame hinge, each upper frame having one or more central connectors connectable to the load, wherein the buoys on each side are arranged in a line that is in the direction of travel, and wherein the buoy axles, lower frame hinges, and the central connectors are parallel to the water surface and perpendicular to the direction of travel.

2. The damping system of claim 1, wherein each buoy rotates about its buoy axle.

3. The damping system of claim 1, wherein one or more of the upper frames are rigidly or pivotally connectable to the load by the one or more central connectors.

4. The damping system of claim 3, wherein an angular position of each of the central connectors is controlled by an electronic means.

5. The damping system of claim 1, further configured such that when the damping system is connected to the load, the buoyancy systems are located at an equal distance from the center of mass of the load.

6. The damping system of claim 1, wherein the buoyancy systems are symmetrically located about the center of mass of the damping system.

7. The damping system of claim 1, further configured such that when the damping system is connected to the load, the at least two buoyancy systems are located at unequal distances from the center of mass of the load.

8. The damping system of claim 1, wherein a distance between each buoyancy system is adaptable for damping a predetermined wavelength of oscillation.

9. A vehicle designed for damping an oscillation of a load and configured to travel on a fluctuant water surface, wherein a direction of travel defines a front, a back, and sides of the load, the vehicle comprising the load and a damping system, wherein the damping system comprises two pairs of buoyancy systems, the pairs positioned on each of the sides of the load, each buoyancy system comprising two buoys, a lower frame and an upper frame, each buoy being pivotally connected to the lower frame by a buoy axle, each lower frame being pivotally connected to the upper frame by a lower frame hinge, each upper frame being connected to the load by one or more central connectors, wherein the buoys on each side of the load are arranged in a line that is in the direction of travel, and wherein the buoy axles, lower frame hinges, and the central connectors are parallel to the water surface and perpendicular to the direction of travel.

10. The vehicle of claim 9, wherein the load is a cargo container.

11. The vehicle of claim 9, wherein each buoy rotates about its buoy axle.

12. The vehicle of claim 9, wherein one or more of the upper frames are rigidly or pivotally connected to the load by the central connectors at an angular position controlled by an electrical means.

* * * * *